US009637895B2

(12) United States Patent
Song et al.

(10) Patent No.: US 9,637,895 B2
(45) Date of Patent: May 2, 2017

(54) INTELLIGENT CONTROL FAUCET

(71) Applicants: Zai Jun Song, Kaiping (CN); Xiamen Forbetter Sanitary Ware Co, Ltd., Xiamen (CN); Xu Dong Zhang, Xiamen (CN)

(72) Inventors: Zai Jun Song, Kaiping (CN); Xi Liang Yan, Xiamen (CN); Yi Hui Chen, Xiamen (CN); Wen Bo Wu, Xiamen (CN)

(73) Assignees: Zai Jun Song, Kaiping, Guangdong (CN); XIAMEN FORBETTER SANITARY WARE CO., LTD., Xiamen, Fujian (CN); Xu Dong Zhang, Xiamen, Fujian (CN)

( * ) Notice: Subject to any disclaimer, the term of this patent is extended or adjusted under 35 U.S.C. 154(b) by 127 days.

(21) Appl. No.: 14/681,052

(22) Filed: Apr. 7, 2015

(65) Prior Publication Data

US 2015/0368888 A1 Dec. 24, 2015

(30) Foreign Application Priority Data

Jun. 20, 2014 (CN) ..... 2014 2 0331760 U

(51) Int. Cl.

| | |
|---|---|
| ***E03B 1/00*** | (2006.01) |
| ***E03C 1/05*** | (2006.01) |
| ***E03C 1/04*** | (2006.01) |
| *E03C 1/02* | (2006.01) |

(52) U.S. Cl.

CPC ..... *E03C 1/057* (2013.01); *E03C 1/0404* (2013.01); *E03C 2001/026* (2013.01); *E03C 2001/0415* (2013.01); *E03C 2001/0417* (2013.01); *Y10T 137/1842* (2015.04)

(58) Field of Classification Search

CPC ..... E03C 1/057; E03C 1/055; E03C 1/0404; E03C 2001/0415; E03C 2001/0417; Y10T 137/87579; Y10T 137/9464; Y10T 137/85946; Y10T 137/1842

See application file for complete search history.

(56) References Cited

U.S. PATENT DOCUMENTS

| | | | | |
|---|---|---|---|---|
| 5,758,690 | A * | 6/1998 | Humpert | E03C 1/0404 137/801 |
| 5,915,417 | A * | 6/1999 | Diaz | E03C 1/057 137/624.11 |
| 8,776,817 | B2 * | 7/2014 | Sawaski | E03C 1/057 137/1 |
| 9,175,458 | B2 * | 11/2015 | Meehan | E03C 1/04 |

(Continued)

*Primary Examiner* — Jessica Cahill
(74) *Attorney, Agent, or Firm* — Leong C. Lei

(57) ABSTRACT

An intelligent control faucet includes a faucet that includes a manual operation valve, an intelligent control module, a water egress tube, a cold water ingress tube, a hot water ingress tube, and a magnetic reed detection device. The water egress tube, the cold water ingress tube, and the hot water ingress tube are connected to the manual operation valve. The intelligent control module is connected, in a series manner, to the water egress tube. The magnetic reed detection device is mounted to the water egress tube and is connected through a feeding cable or directly to the intelligent control module. Water flow can be established or cut off through pulling the water egress tube so that the use is made easy.

6 Claims, 14 Drawing Sheets

(56) References Cited

U.S. PATENT DOCUMENTS

| | | | | |
|---|---|---|---|---|
| 2006/0006354 | A1* | 1/2006 | Guler | E03C 1/057 251/129.04 |
| 2009/0049599 | A1* | 2/2009 | Parsons | E03C 1/057 4/623 |
| 2012/0055557 | A1* | 3/2012 | Belz | E03C 1/057 137/1 |
| 2012/0227849 | A1* | 9/2012 | Rodenbeck | E03C 1/057 137/897 |
| 2013/0248019 | A1* | 9/2013 | Frick | E03C 1/04 137/468 |
| 2013/0276911 | A1* | 10/2013 | Meehan | E03C 1/04 137/355.16 |
| 2014/0000733 | A1* | 1/2014 | Jonte | E03C 1/05 137/552 |
| 2015/0368888 | A1* | 12/2015 | Song | E03C 1/057 137/78.1 |

* cited by examiner

INTELLIGENT CONTROL FAUCET

(A) TECHNICAL FIELD OF THE INVENTION

The present invention relates generally to a faucet, and more particularly to an intelligent control faucet.

(B) DESCRIPTION OF THE PRIOR ART

A conventional countertop faucet is generally designed according to the outside looking of the faucet and is generally mechanically operated with hands. The increasing emergence of electronic detective faucets in the market makes the automatic faucets a consequential choice. An automatic faucet detects the presence of a human body and acquires a signal that is transmitted subsequently to a control module so as to have power supplied from a power supply to a water supply system. The water supply system is thus enabled to control switching of water to supply water to the user. Such a conventional automatic faucet, including pull-out faucets, is generally controlled with a control module that acquires an opening/closing signal through an infrared sensor. Due be being of a unique feature, the conventional pull-out faucet, although generally arranged at a site around which use of water is necessary, allows a sprayer thereof to be pulled out in a condition of water being discharged to flush a distant site. Currently, no proposal has been made in this art for achieving the control of opening/closing the water supply through the movement of pulling out the sprayer. It is thus desired to provide a solution that achieves such a way of control.

SUMMARY OF THE INVENTION

An object of the present invention is to provide an intelligent control faucet featuring easy and convenient use.

To achieve the above object, a technical solution adopted in the present invention is as follows:

An intelligent control faucet comprises a faucet body that includes a manual operation valve, an intelligent control module, a water egress tube, a cold water ingress tube, a hot water ingress tube, and a sprayer connected to the tubes through a pull-out hose, in which the water egress tube, the cold water ingress tube, and the hot water ingress tube are connected to the manual operation valve that is mounted inside the faucet body and the intelligent control module is connected, in a series manner, to the water egress tube, and further comprises a magnetic reed detection device, wherein the magnetic reed detection device is mounted to the water egress tube and is connected through a feeding cable or directly to the intelligent control module.

The present invention further comprises an infrared sensor, wherein the infrared sensor is mounted to the faucet body that is mounted on a countertop and is connected through a feeding cable or directly to the intelligent control module.

The infrared sensor comprises a sensing window mounted to a front side of the faucet body and a sensor chip, wherein the sensing window has a lower end coupled to a rubber sealing block and a waterproof connection to connect through a feeding cable to the intelligent control module and the sensor chip is mounted through a rubber block at a location behind the sensing window.

The magnetic reed detection device comprises a magnetic reed switch and a magnetic activation mechanism that selectively activates the magnetic reed switch, wherein the magnetic reed switch is mounted in the faucet body to face a moving path of the magnetic activation mechanism and is connected through a feeding cable or directly to the intelligent control module.

The magnetic activation mechanism is mounted to the pull-out hose and the magnetic activation mechanism controls activation/deactivation of the magnetic reed switch to control communication between the water egress tube and the pull-out hose.

The magnetic activation mechanism comprises a magnetic ring mounted to the pull-out hose.

The pull-out hose comprises a first hose and a second hose, wherein the magnetic activation mechanism is mounted between the first hose and the second hose and the first hose has a connection end to which a secondary metallic fitting is mounted and the second hose has a connection end to which a primary metallic fitting is mounted, the two metallic fittings collectively forming a sealed coupling therebetween through inter-fitting between the primary and secondary fittings, wherein the secondary metallic fitting receives the magnetic ring to fit thereto and when the pull-out hose retracts back to a home position in the faucet body, the magnetic ring is located in a spatial range that deactivates the magnetic reed switch.

Protection enclosures are provided outside the secondary metallic fitting, the primary metallic fitting, and the magnetic ring of the pull-out hose.

The magnetic activation mechanism comprises a magnet and a demagnetization member, wherein the magnet is mounted in the faucet body at a location facing the magnetic reed switch and the demagnetization member is mounted to the pull-out hose, whereby when the pull-out hose retracts back to a home position in the faucet body, the demagnetization member is located in a spatial range that deactivates the magnetic reed switch.

The demagnetization member is in an annular form fit over the secondary metallic fitting or directly mounted to the hose.

Protection enclosures are provided outside the secondary metallic fitting, the primary metallic fitting, and the demagnetization member of the pull-out hose.

With such a solution, the present invention comprises a magnetic reed detection device mounted to a water egress tube and is connected through a feeding cable or directly to an intelligent control module to feed a control signal to the intelligent control module for establishing or cutting of a water flow through the faucet. Such an arrangement of establishing or cutting of a water flow through pulling a water egress tube makes the use easy.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
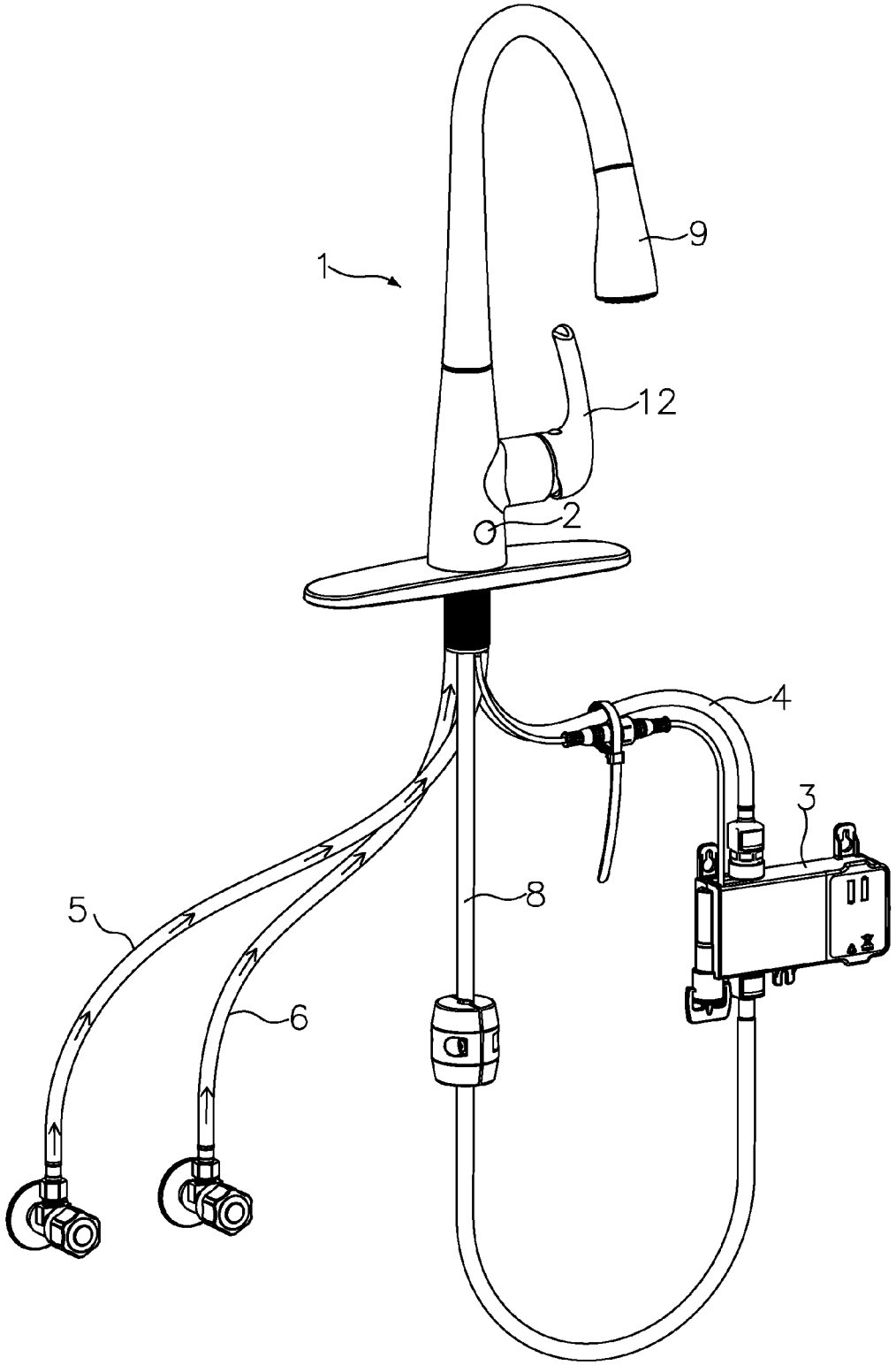
FIG. 1 is a schematic view showing the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1-14, the present invention discloses an intelligent control faucet, which comprises a faucet body 1 in which a manual operation valve 11 is included, an intelligent control module 3, a water egress tube 4, a cold water ingress tube 5, a hot water ingress tube 6, and a magnetic reed detection device 7 and further comprises a sprayer 9 that is connected to the tube 4 through a pull-out hose 8. The water egress tube 4, the cold water ingress tube 5, and the hot water ingress tube 6 are connected to the manual operation valve 11 that is mounted inside the faucet body 1. The intelligent control module 3 is connected, in a series manner, to the water egress tube and faucet body 1 comprises an infrared sensor 2.

Figure 9:
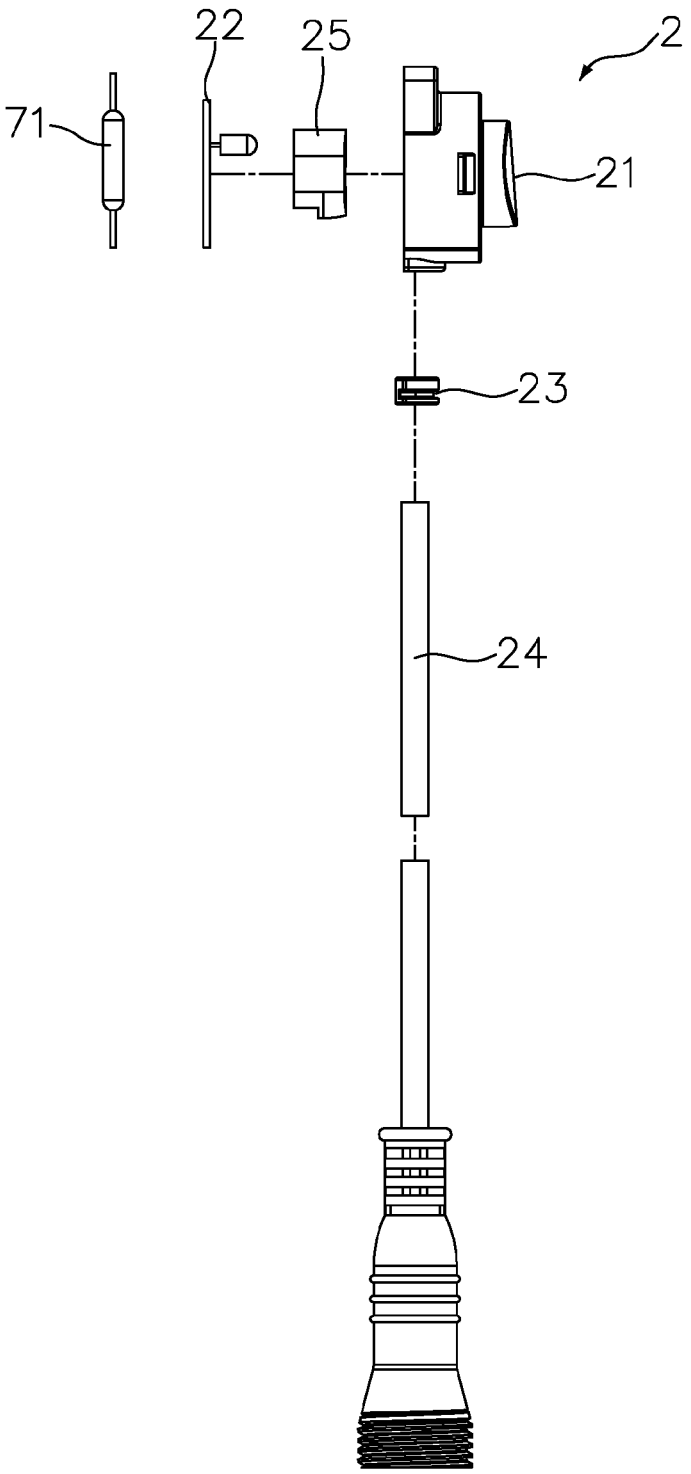
FIG. 9 is an exploded view illustrating a detection module of the present invention.

As shown in FIG. 9, in combination with FIG. 1, the infrared sensor 2 is mounted to the faucet body 1 that is mounted on for example a countertop and is connected, through a feeding cable or directly, to the intelligent control module 3 and comprises a sensing window 21 mounted to a front side of the faucet body 1 and a sensor chip 22. The sensing window 21 has a lower end coupled to a rubber sealing block 23 and a waterproof connection 24 to connect through a feeding cable to the intelligent control module 3. The sensor chip 22 is mounted through a rubber block 25 at a location behind the sensing window 21.

The intelligent control module 3 is generally arranged at a location below for example a basin and is generally composed of an electromagnetic valve and a cell box to control communication between the water egress tube 4 and the pull-out hose 8. The pull-out hose 8 has a front end coupled to the sprayer 9. The manual operation valve 11 (see FIG. 3) is operated with the faucet handle 12.

Figure 3:
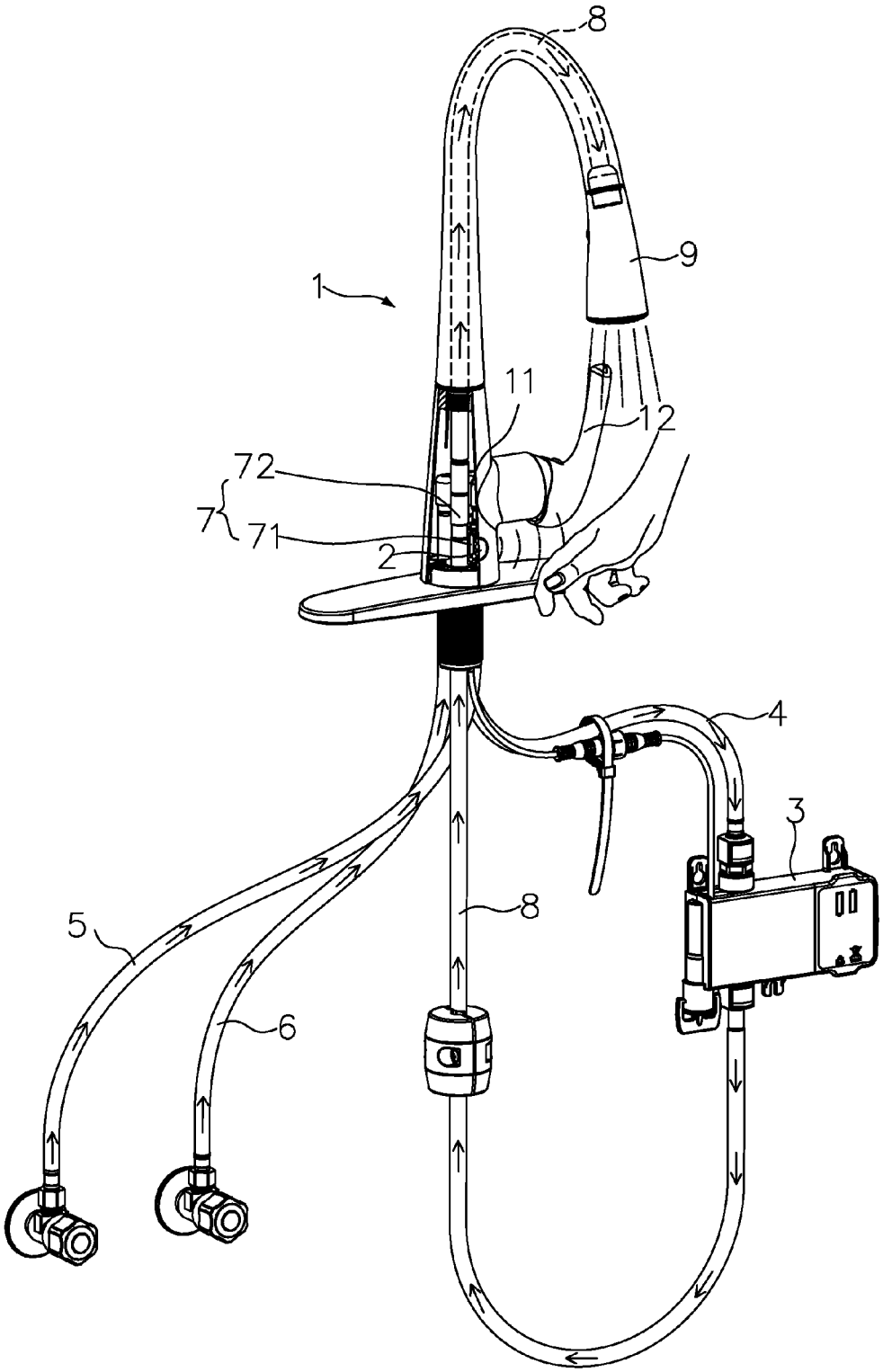
FIG. 3 is a schematic view illustrating a water discharging condition of the present invention activated through infrared detection.
Figure 12:
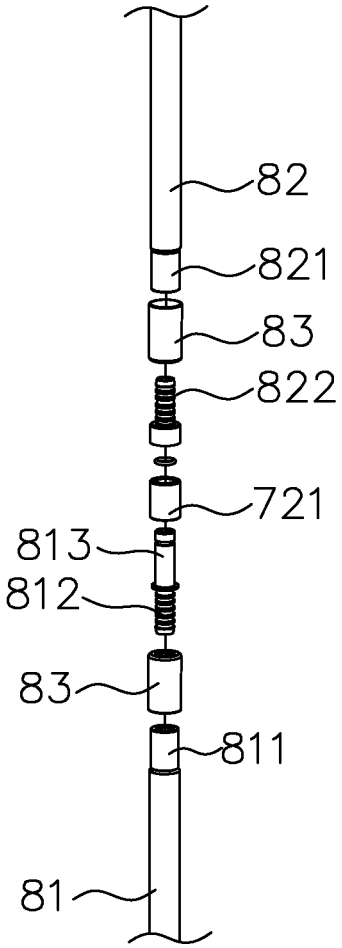
FIG. 12 is an exploded view showing a first example of a magnetic reed detection device according to the present invention.

Referring to FIGS. 3 and 12, the magnetic reed detection device 7 comprises a magnetic reed switch 71 and a magnetic activation mechanism 72 that functions to activate the magnetic reed switch. The magnetic reed switch 71 is mounted in the faucet body 1 at the side facing a moving path of the magnetic activation mechanism 72 and is connected through a feeding cable or directly to the intelligent control module 3. The magnetic activation mechanism 72 is mounted to the pull-out hose 8 and the magnetic activation mechanism 72 controls activation/deactivation of the magnetic reed switch 71 to control the communication between the water egress tube 4 and the pull-out hose 8.

Figure 10:
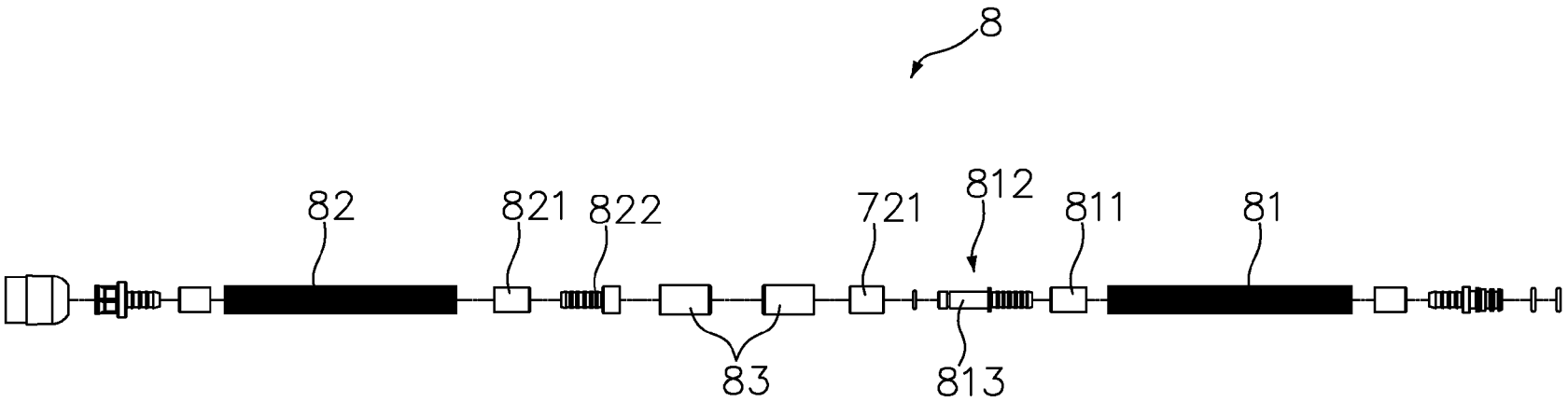
FIG. 10 is an exploded view of a pull-out hose according to the present invention.
Figure 11:
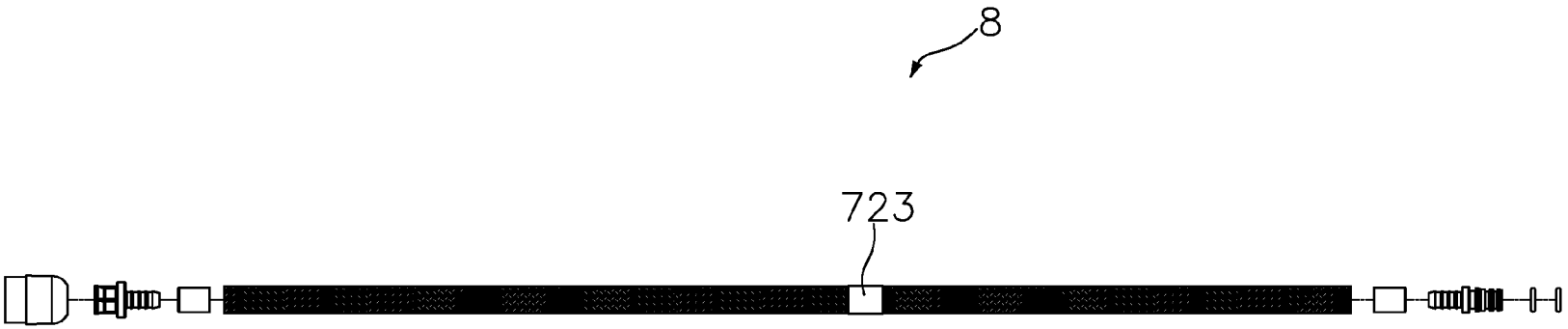
FIG. 11 is another exploded view of the pull-out hose of the present invention.

As shown in FIG. 10, the pull-out hose 8 comprises a first hose 81 and a second hose 82. A first example of the magnetic activation mechanism 72 comprises a magnetic ring 721 that is mounted between the first hose 81 and the second hose 82. The first hose 81 has a connection end to which a secondary metallic fitting 812 is mounted through a steel sleeve 811 and the second hose 82 has a connection end to which a primary metallic fitting 822 is mounted through a steel sleeve 821, whereby the two metallic fittings collectively form a sealed coupling therebetween through interfitting between the primary and secondary fittings. The secondary metallic fitting 812 comprises a neck 813 formed thereon to receive the magnetic ring 721 to fit thereto. When the pull-out hose 8 retracts back to a home position inside the faucet body 1, the magnetic ring 721 is located in a spatial range that deactivates the operation of the magnetic reed switch 71 (see FIGS. 3 and 9). To maintain integrity of the entire pull-out hose 8, protection enclosures 83 are provided outside the secondary metallic fitting 812, the primary metallic fitting 822, and the magnetic ring 721.

Figure 13:
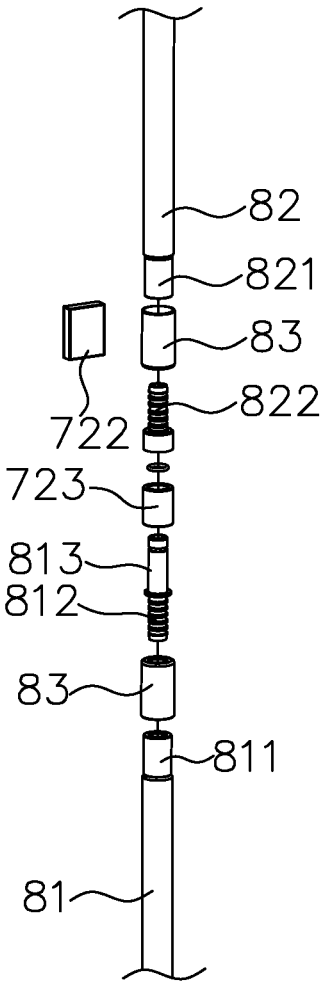
FIG. 13 is an exploded view showing a second example of a magnetic reed detection device according to the present invention.

As shown in FIG. 13, in combination with FIG. 3, a second example of the magnetic activation mechanism 72 comprises a magnet 722 and a demagnetization member 723, wherein the magnet 722 is mounted in the faucet body 1 at a location facing the magnetic reed switch 71 and the demagnetization member 723 is in an annular form that is fit over the neck 813 of the secondary metallic fitting 812. When the pull-out hose 8 retracts back to the home position inside the faucet body 1, the demagnetization member 723 is located in a spatial range that deactivates the operation of the magnetic reed switch 71. Similarly, to maintain the integrity of the entire pull-out hose 8, protection enclosures 83 are provided outside the secondary metallic fitting 812, the primary metallic fitting 822, and the magnetic ring 721.

Figure 14:
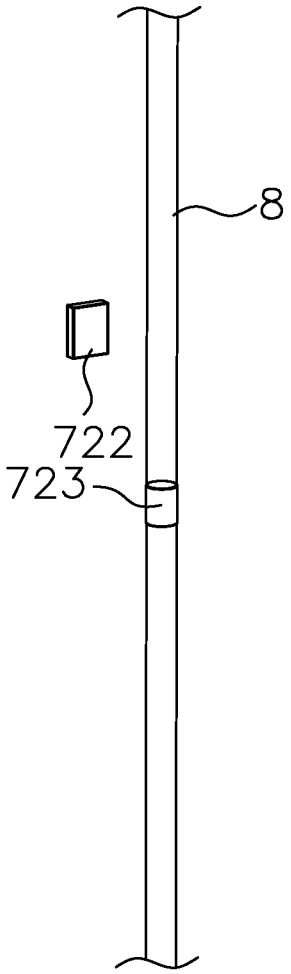
FIG. 14 is another exploded view showing the second example of the magnetic reed detection device according to the present invention.

As shown in FIG. 14, in combination with FIG. 3, a second example of the magnetic activation mechanism 72 comprises a magnet 722 and a demagnetization member 723, wherein the magnet 722 is mounted in the faucet body 1 at a location facing the magnetic reed switch 71 and the demagnetization member 723 is in an annular form directly fit over the pull-out hose. When the pull-out hose 8 retracts back to the home position inside the faucet body 1, the demagnetization member 723 is located in a spatial range that deactivates the operation of the magnetic reed switch 71.

The operation of the present invention is as follows:

As shown in FIG. 1, the faucet handle 12 is in a closed position, wherein water flow through the faucet is in a shut-down condition.

Figure 2:
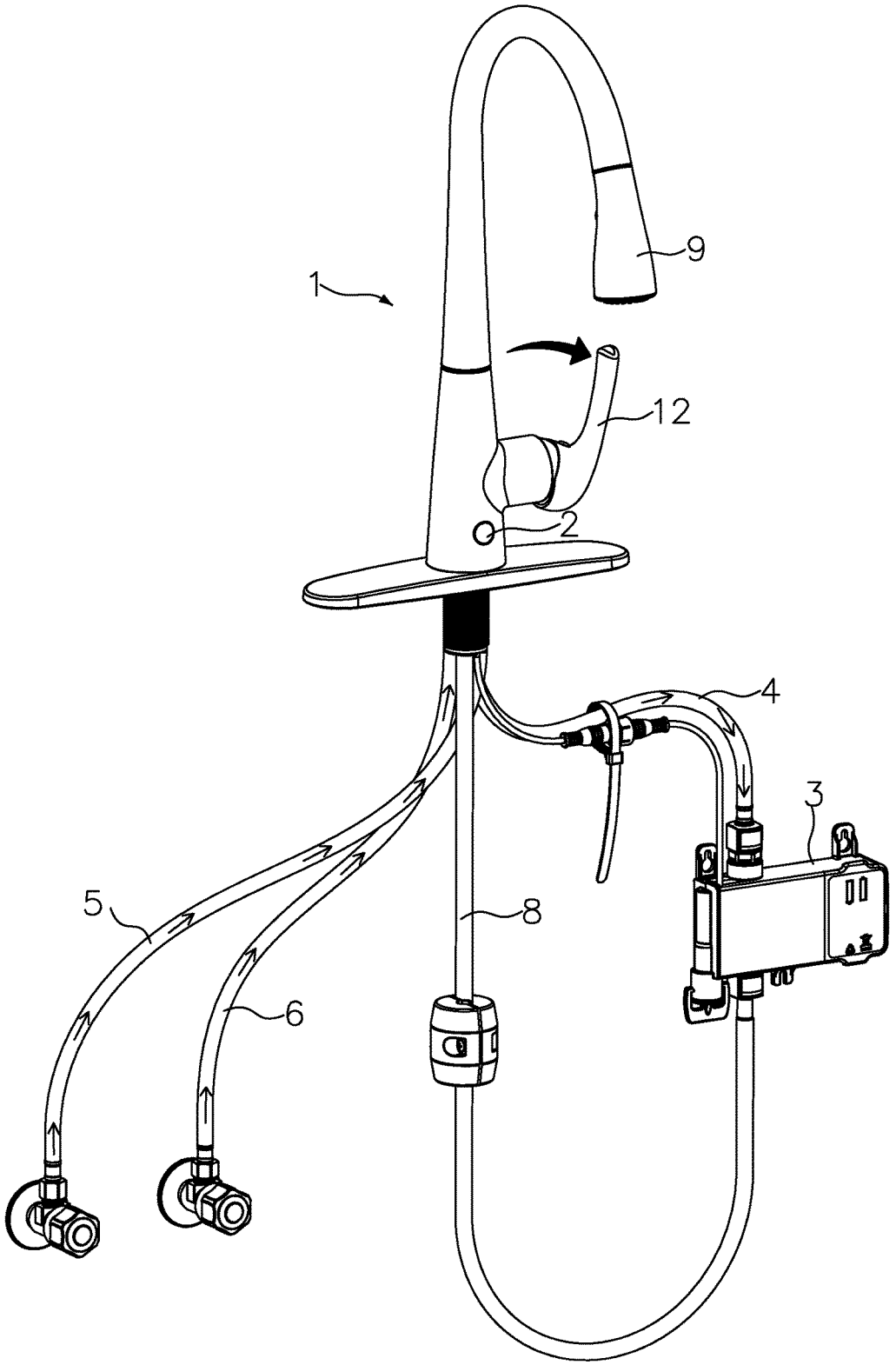
FIG. 2 is a schematic view illustrating an opening operation of a faucet handle of the present invention.

As shown in FIG. 2, when the faucet handle 12 is opened and the infrared sensor 2 and the magnetic reed detection device 7 are both not put into an operation and thus in a water shut-down condition.

As shown in FIG. 3, the infrared sensor 2 is activated and water is discharged through the sprayer 9. When a predetermined lapse of time reaches, the faucet 1 automatically shuts down the water flow.

Figure 4:
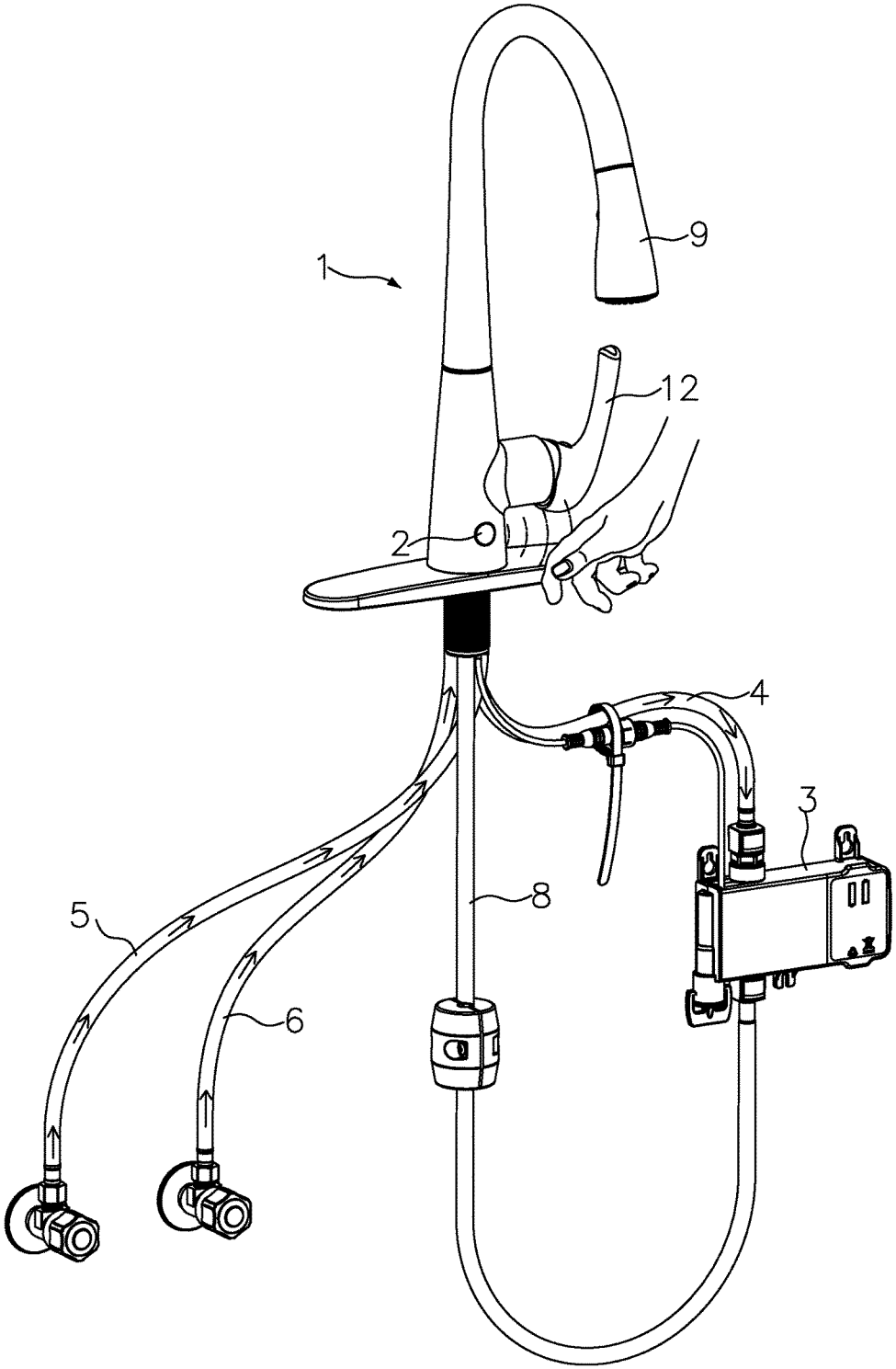
FIG. 4 is a schematic view illustrating a water shut-down condition of the present invention activated through infrared detection.

As shown in FIG. 4, the faucet handle 12 is opened and with the sprayer 9 in a condition of discharging water, the infrared sensor 2 is activated to have the sprayer 9 shut down the water flow or the handle 12 is closed to have the sprayer 9 shut down the water flow.

Figure 5:
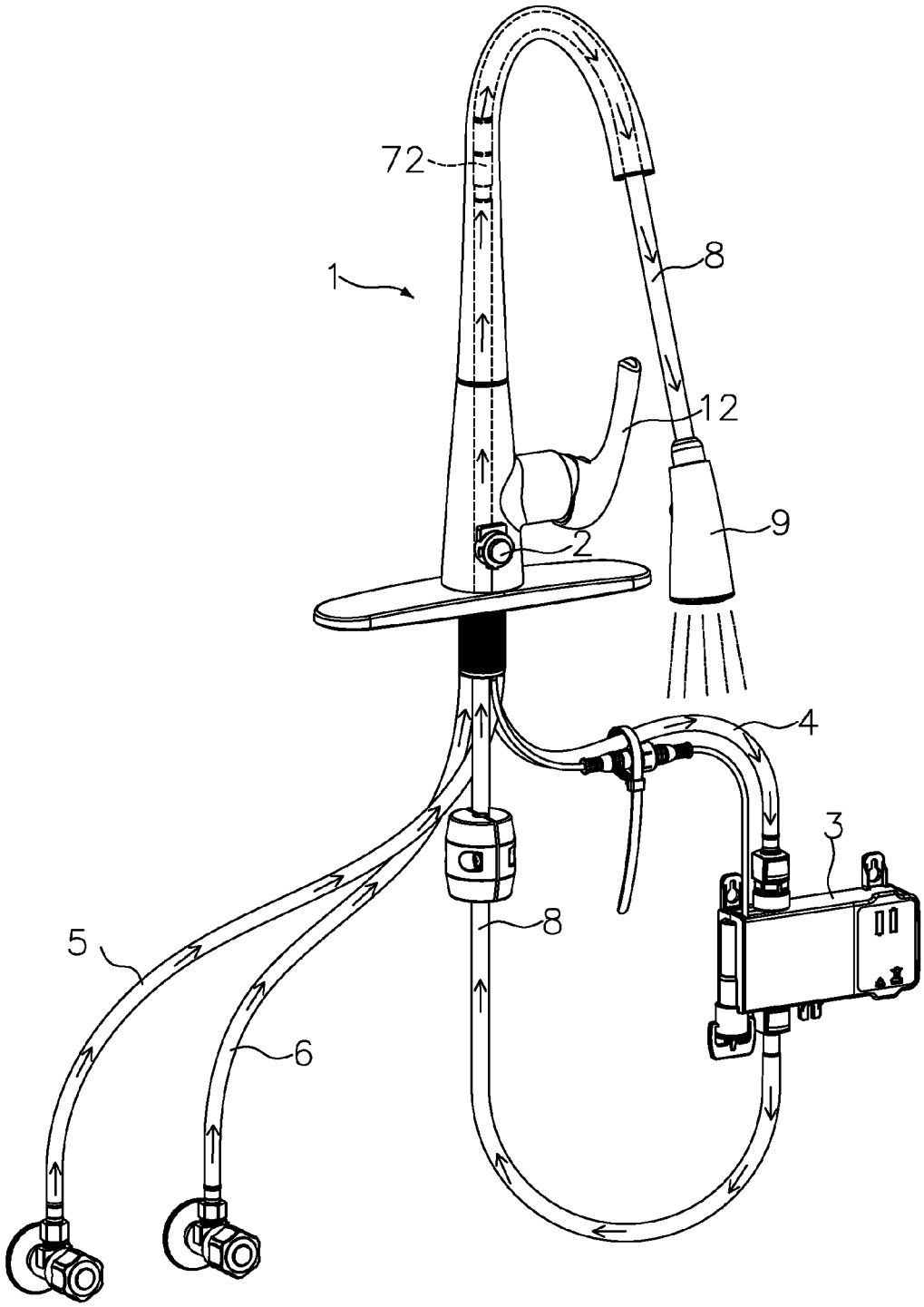
FIG. 5 is a schematic view illustrating a water discharging condition of the present invention activated through pulling a sprayer out.

As shown in FIG. 5, the faucet handle 12 is opened (with the infrared sensor 2 being in a water shut-down condition) and the sprayer 9 is pulled down so as to allow the pull-out hose 8 to extend out of the faucet body 1, whereby the movement of the pull-out hose 8 causes the magnetic activation mechanism 72 to move upward and away from the magnetic reed switch 71 (see FIG. 3) so that the magnetic reed switch 71 transmits an activation signal to the intelligent control module 3 (where the sprayer 9 maintains in a condition of discharging water when the sprayer is pulled down in a condition when the sprayer 9 is discharging water) and thus water is discharging from the sprayer 9. Under this condition, the infrared sensor 2 of the faucet body 1 is in a disabled condition. When a predetermined lapse of time reaches, the sprayer 9 shuts down the water flow and the infrared sensor 2 restores the sensing faction thereof. When it is necessary to have water discharged from the sprayer 9, the infrared sensor 2 may be activated (where the function of the infrared sensor 2 for enabling water discharging may be restored back to the normal condition when a predetermined lapse of time is reached after water discharging enabled through pulling out is).

Figure 6:
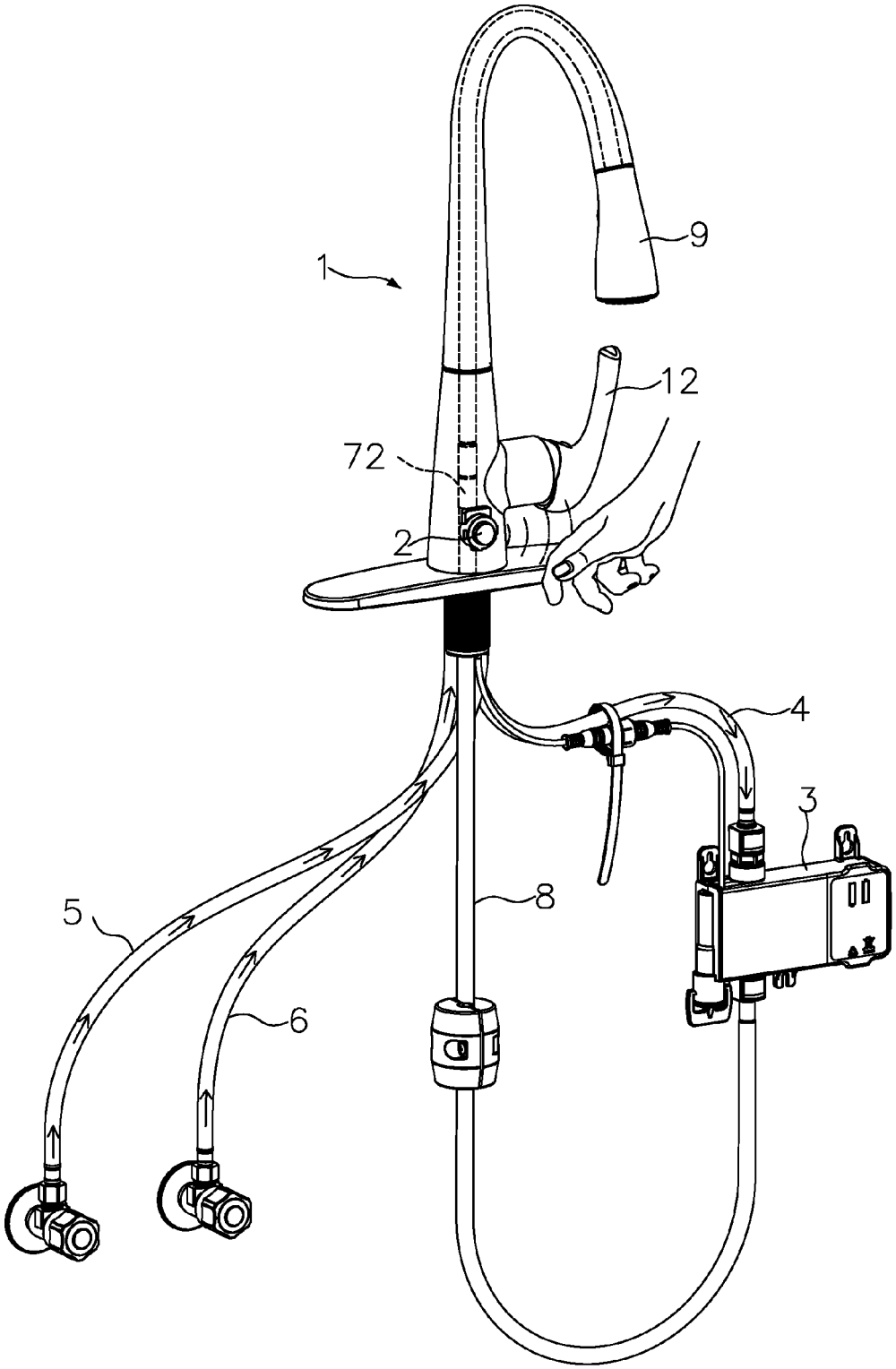
FIG. 6 is a schematic view illustrating disabling of the detection through opening of a handle.

The following conditions should also be noted:

As shown in FIG. 6, when the faucet is in a sensing condition, if the faucet handle 12 is closed, no water discharging is enabled through sensing.

Figure 7:
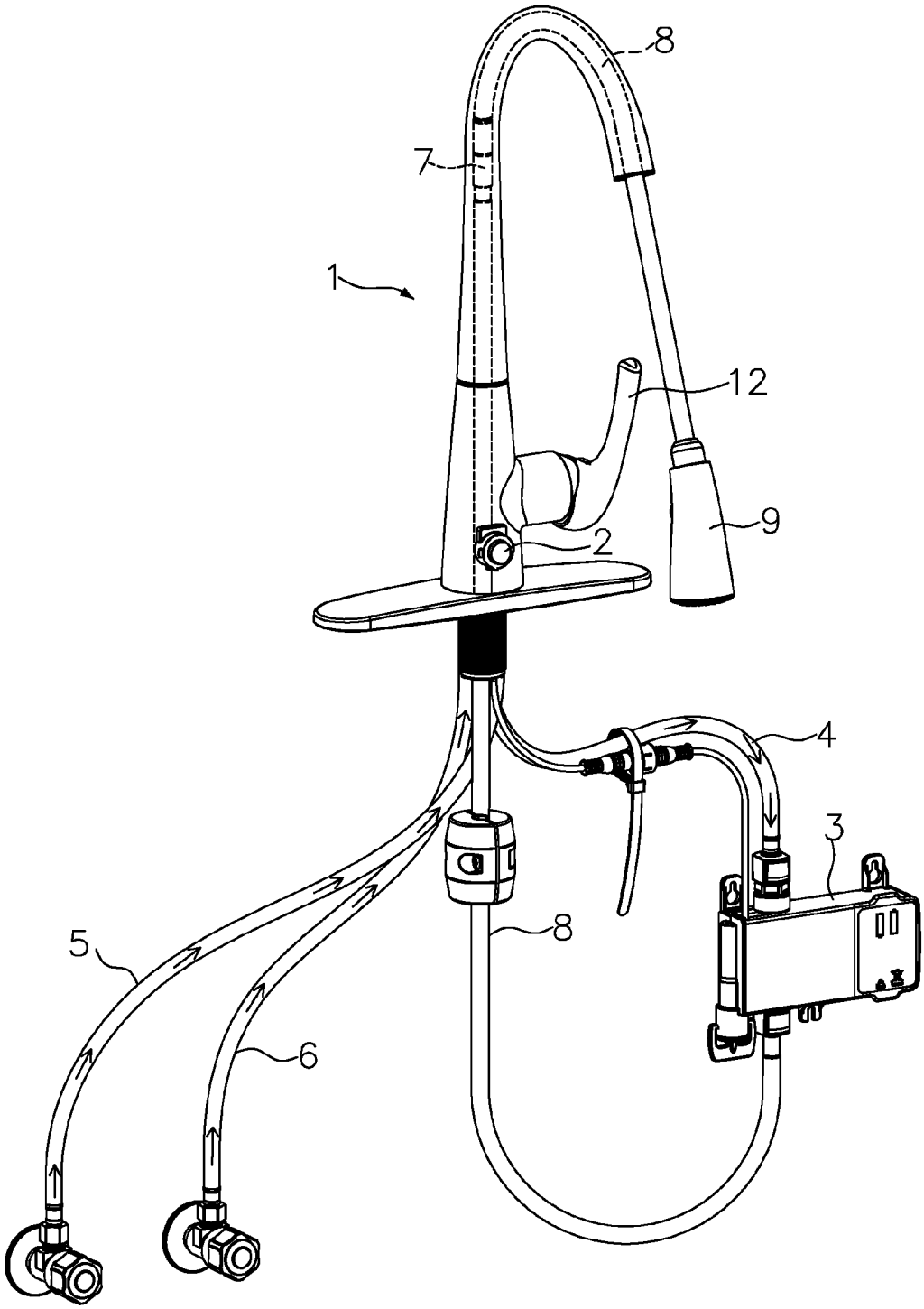
FIG. 7 is a schematic view illustrating disabling of sprayer-pulling activated water discharging through opening of the handle.

As shown in FIG. 7, when the faucet is in a pull-out detection condition, if the faucet handle 12 is closed, no water discharging is enabled through detection.

Figure 8:
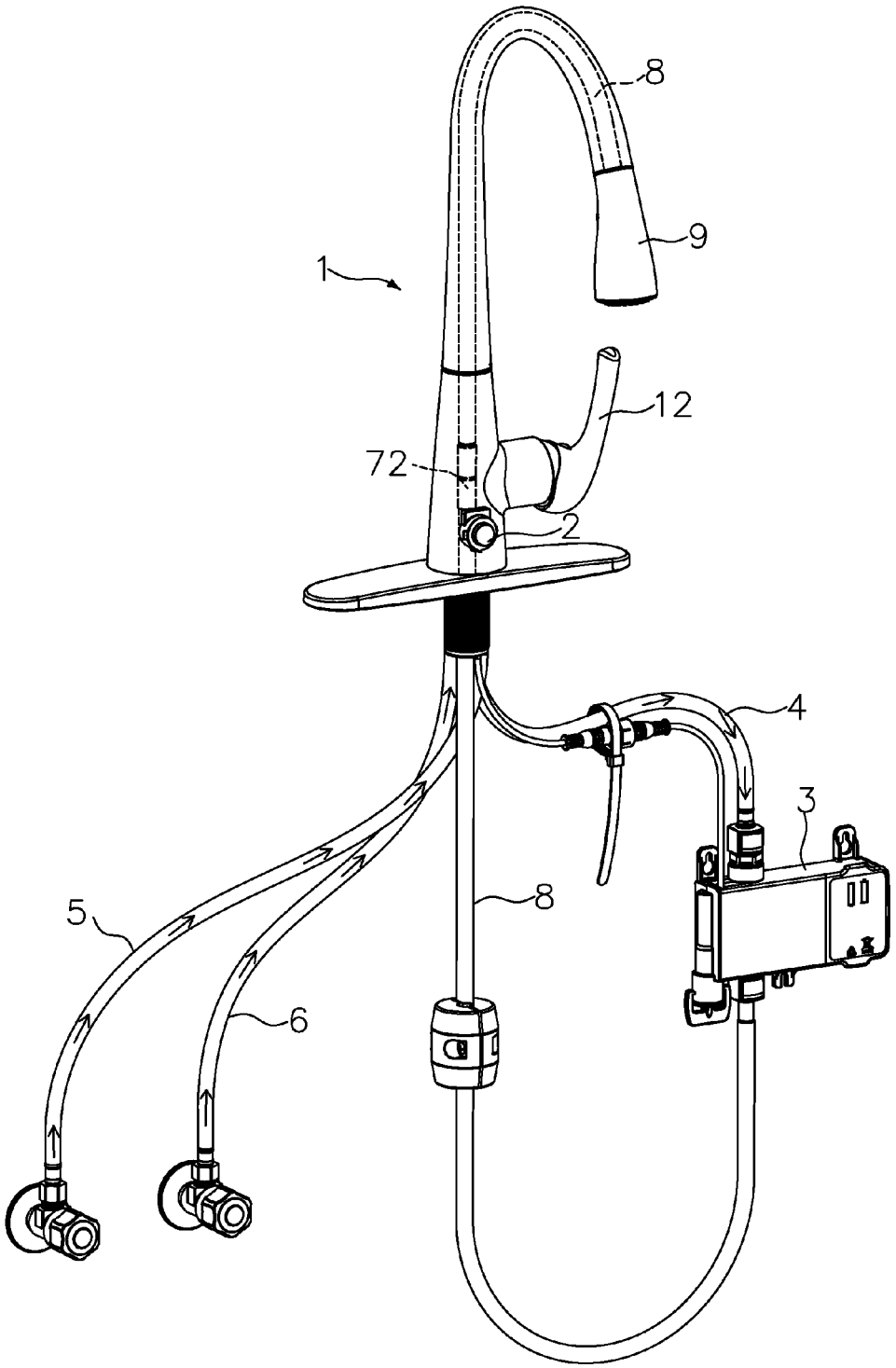
FIG. 8 is a schematic view illustrating shutting down water through retraction of the sprayer back to home position and the faucet handle closed.

As shown in FIG. 8, in a condition when the faucet handle 12 is opened and water discharging activated through pulling out is enabled, when the sprayer 9 is set back to the home position, the faucet shuts down the water flow due to the operation of the magnetic reed detection device 7.

As shown in FIG. 1, when the faucet is in a condition of water discharging activated through sensing or water discharging activated through pulling out, closing the handle 12 shuts down the water flow.

An essential gist of the present invention is to control water discharging through a faucet with a magnetic reed detection device 7.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

We claim:

1. An intelligent control faucet, comprising a faucet body that includes a manual operation valve, an intelligent control module, a water egress tube, a cold water ingress tube, a hot water ingress tube, and a sprayer connected to the tubes through a pull-out hose, wherein the water egress tube, the cold water ingress tube, and the hot water ingress tube are connected to the manual operation valve that is mounted inside the faucet body and the intelligent control module is connected, in a series manner, to the water egress tube, characterized by further comprising a magnetic reed detection device, wherein the magnetic reed detection device is mounted to the water egress tube and is connected through a feeding cable or directly to the intelligent control module, the magnetic reed detection device comprises a magnetic reed switch and a magnetic activation mechanism that selectively activates the magnetic reed switch, the magnetic reed switch is mounted in the faucet body to face a moving path of the magnetic activation mechanism and is connected through a feeding cable or directly to the intelligent control module, and the magnetic activation mechanism is mounted to the pull-out hose and the magnetic activation mechanism controls activation/deactivation of the magnetic reed switch to control communication between the water egress tube and the pull-out hose.

2. The intelligent control faucet according to claim 1, characterized by further comprising an infrared sensor, wherein the infrared sensor is mounted to the faucet body that is mounted on a countertop and is connected through a feeding cable or directly to the intelligent control module.

3. The intelligent control faucet according to claim 2, characterized in that the infrared sensor comprises a sensing window mounted to a front side of the faucet body and a sensor chip, wherein the sensing window has a lower end coupled to a rubber sealing block and a waterproof connection to connect through a feeding cable to the intelligent control module and the sensor chip is mounted through a rubber block at a location behind the sensing window.

4. The intelligent control faucet according to claim 1, characterized in that the magnetic activation mechanism comprises a magnetic ring mounted to the pull-out hose.

5. The intelligent control faucet according to claim 4, characterized in that the pull-out hose comprises a first hose and a second hose, wherein the magnetic activation mechanism is mounted between the first hose and the second hose and the first hose has a connection end to which a secondary metallic fitting is mounted and the second hose has a connection end to which a primary metallic fitting is mounted, the two metallic fittings collectively forming a sealed coupling therebetween through inter-fitting between the primary and secondary fittings, wherein the secondary metallic fitting receives the magnetic ring to fit thereto and when the pull-out hose retracts back to a home position in the faucet body, the magnetic ring is located in a spatial range that deactivates the magnetic reed switch.

6. The intelligent control faucet according to claim 5, characterized in that protection enclosures are provided outside the secondary metallic fitting, the primary metallic fitting, and the magnetic ring of the pull-out hose.

* * * * *